United States Patent [19]

Silberman

[11] Patent Number: 4,546,968

[45] Date of Patent: Oct. 15, 1985

[54] ADJUSTABLE BENCH MOUNTED LEG LIFT EXERCISER

[75] Inventor: Ira J. Silberman, Opelika, Ala.

[73] Assignee: Diversified Products Corporation, Opelika, Ala.

[21] Appl. No.: 428,365

[22] Filed: Sep. 29, 1982

[51] Int. Cl.[4] ..... A01B 23/04

[52] U.S. Cl. ..... 272/117

[58] Field of Search ..... 272/117, 118, 134, 132, 272/144, 145; 128/25 R, 71, 75

[56] References Cited

U.S. PATENT DOCUMENTS

| | | | |
|---|---|---|---|
| 3,120,954 | 2/1964 | Apostol . | |
| 3,850,430 | 11/1974 | Hamilton | 272/117 |
| 4,098,502 | 7/1978 | Faust . | |
| 4,183,520 | 1/1980 | Chase . | |
| 4,188,029 | 2/1980 | Brower . | |
| 4,197,839 | 4/1980 | Lay | 272/144 |
| 4,256,302 | 3/1981 | Keiser et al. | 272/134 |
| 4,316,609 | 2/1982 | Silberman | 272/117 |
| 4,319,747 | 3/1982 | Rogers . | |
| 4,358,108 | 11/1982 | Voris | 272/134 |

OTHER PUBLICATIONS

Universal Gym Machines, 1974, p. 28.

*Primary Examiner*—Richard J. Johnson

*Attorney, Agent, or Firm*—Banner, Birch, McKie & Beckett

[57] ABSTRACT

The invention described and claimed herein provides for an L-shaped member comprising a first arm and a second arm substantially perpendicular to the first arm. An ankle engaging member is fixed to each of the arms. A weight support is attached to the second arm. The leg lift device includes a mounting bracket pivotably supporting the L-shaped rod. The mounting bracket is adapted to be fastened to an exercise bench. The leg lift device further comprises an adjustable and removable knee support fixed to the mounting bracket.

8 Claims, 5 Drawing Figures

ADJUSTABLE BENCH MOUNTED LEG LIFT EXERCISER

BACKGROUND OF THE INVENTION

1. Technical Field

The present invention relates to a user-manipulated, force resisting exercise device for exercising the legs. In particular, the invention relates to a leg exercise device which has an adjustable knee support to provide proper positioning of the leg and accommodate users of various sizes.

2. Background Art

Various types of leg exercising devices are well-known in the art. In an arrangement which is typical, a leg lift device is used in conjunction with a bench or chair. The user sits on the bench with his or her legs hanging straight down. One or both of the user's ankles are hooked around a padded crossbar of a pivotable, weighted lever arm assembly connected to the bench. By applying pressure to the crossbar and straightening his or her legs, the user exercises the quadricep muscles, the large muscles of the front of the thigh. It is also common to equip these exercise devices with a second padded crossbar which allows the user to lie on the bench and engage the second crossbar with the back of the user's ankles. By bending the knee joint and applying a force against the crossbar, the user can rotate the pivotable, weighted exercise device. This exercises the hamstring muscles, the large muscles on the back of the thigh.

When exercising the quadricep muscles, however, many prior art devices have not taken into account the need to provide a device which accommodates users of various sizes. In order to perform a leg lift exercise for the quadriceps safely and obtain maximum benefit, it is essential that the user's knee be supported by a support underneath the knee and that the user's foot engage the exercise device at or near the ankle joint. This ensures that the maximum moment arm—the distance between the knee and contact with the weighted resistance—is used.

Some prior art devices have permitted the user to adjust a leg lift device to a comfortable position. For example, in my prior patent, U.S. Pat. No. 4,316,609, an adjustable leg lift device is shown. However, in this device the distance between the knee support crossbar and the ankle engaging crossbar is fixed. The device can be adjusted only to elevate the knee but not to adjust the moment arm between the knee and ankle. Thus, users with very short or very long legs must use the exercise device in a way which will not provide the maximum benefit of the exercise and may place an undue strain on certain muscles, bones, or joints.

Other adjustable leg exercise devices are also known. For example, U.S. Pat. No. 4,256,302 discloses a leg lift device mounted on a chair. The device is adjustable by raising or lowering the ankle engaging portion of the leg lift device. However, the device does not provide an adjustable knee support. U.S. Pat. No. 3,850,430 discloses an adjustable leg exercise device intended to be used on the floor. In this device the weight pivot arm is pivoted to the knee support. The device does not allow the support for the knee to be independently adjusted relative to the position of the ankle.

SUMMARY OF THE INVENTION

The present invention provides a leg lift exercise device which is adjustable to accommodate users of various sizes. The invention ensures that the user's leg is properly positioned for performing a leg lift exercise so that the maximum benefits of the exercise can be obtained. Proper support of the knee relative to the ankle also helps to prevent undue strain from being placed on the legs.

The knee support of the present exercise device is both adjustable and removable. The knee support may be removed so that the device can be used for exercising the hamstring muscles. The leg lift exercising device is intended to be removably attached to an exercise bench and provides a system for easily applying weights of varying resistance to the device. The adjustable knee support also permits the invention to be used on exercise benches of a lower height than the prior art devices.

Accordingly, the invention described and claimed herein provides for an L-shaped member comprising a first arm and a second arm substantially perpendicular to the first arm. An ankle engaging member is fixed to each of the arms. A weight support is attached to the second arm. The leg lift device includes a mounting bracket pivotably supporting the L-shaped rod. The mounting bracket is adapted to be fastened to an exercise bench. The leg lift device further comprises an adjustable and removable knee support fixed to the mounting bracket.

BEST MODE FOR CARRYING OUT THE INVENTION

Figure 1:
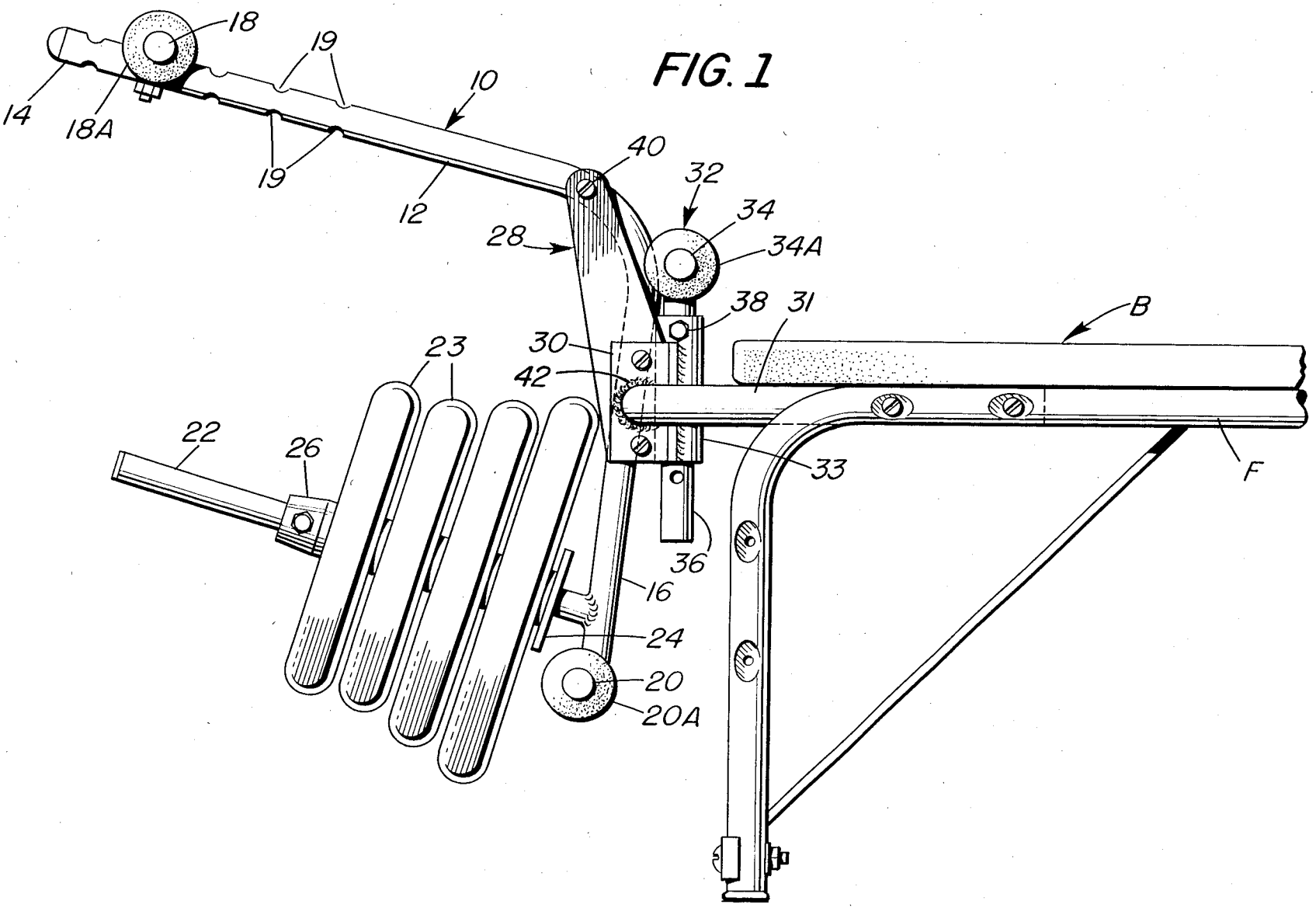
FIG. 1 is a side elevational view of the adjustable exercise device of the invention mounted on a bench.
Figure 2:
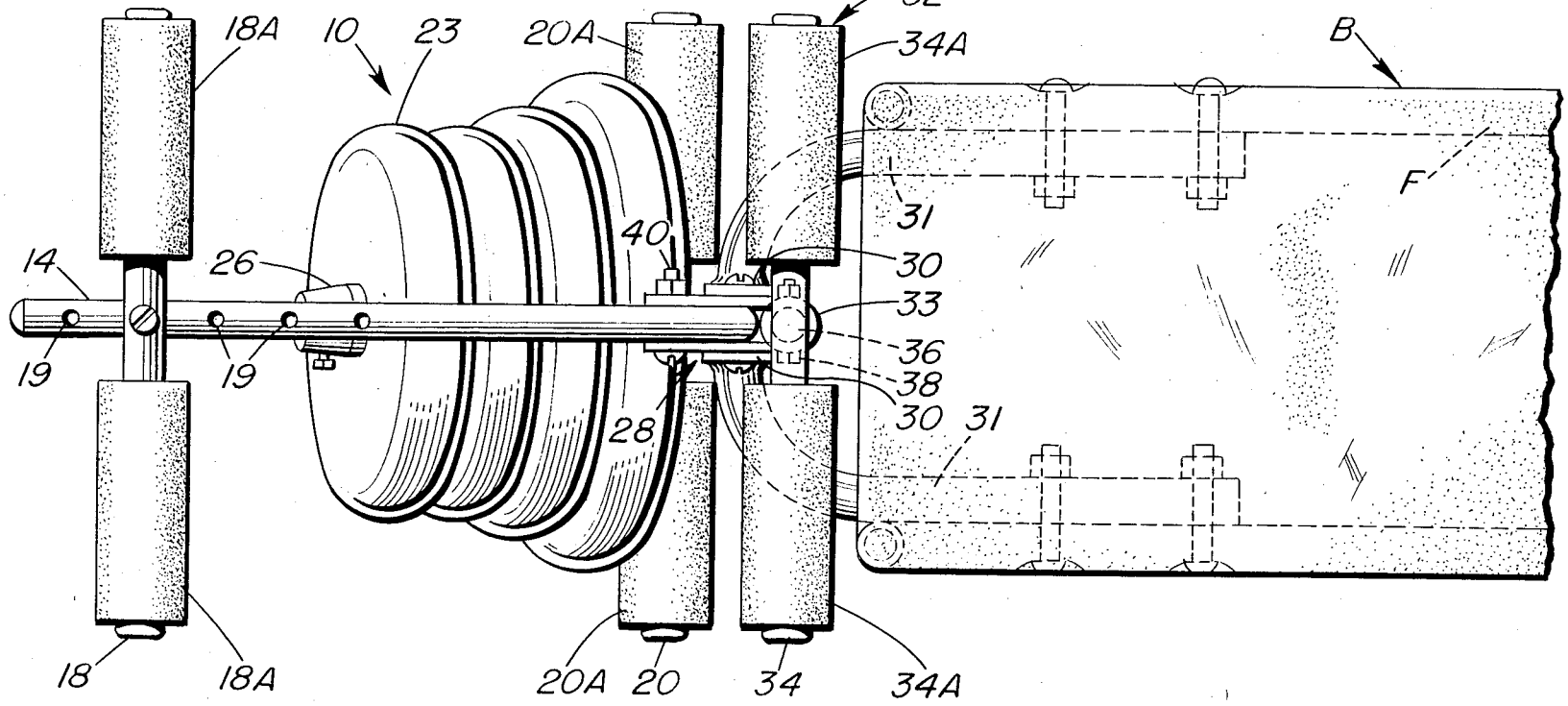
FIG. 2 is a top plan view of the adjustable exercise device.
Figure 3:
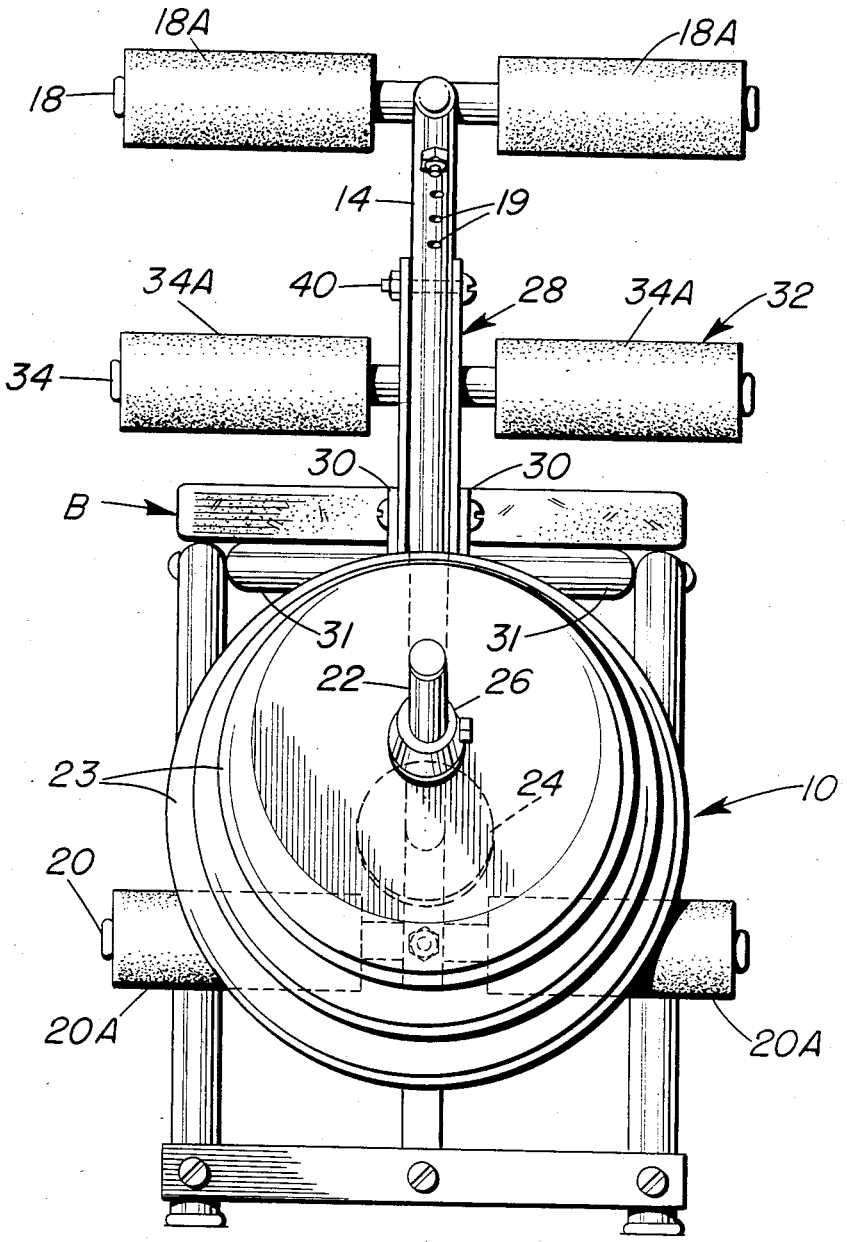
FIG. 3 is a front elevational view of the adjustable exercise device.

In a preferred embodiment, the leg lift device of the present invention is intended to be attached to an exercise bench, although it is obvious that other chair-like devices also could be used. The exercise bench may be of any conventional construction. The leg lift device may be attached to either the horizontal frame of the bench, as shown in FIGS. 1–5, or to the vertical legs of the bench.

The leg lift device is shown generally at 10. The device includes an L-shaped rod or bar shown at 12. The L-shaped rod comprises a first arm 14 which, when mounted, and when the exercise device is in its resting position, is essentially parallel to the top surface of the bench to which it is attached. The L-shaped rod includes a second arm 16 which is essentially perpendicular to the first arm 14. Near the end of the first arm 14 is an ankle engaging bar 18 which is intended primarily to be used when exercising the hamstring muscles. The position of bar 18 along the length of arm 14 is variable by bolting through any one of a series of holes 19. Near the end of the second arm 16 is an ankle engaging bar 20 which is intended to be used primarily when exercising the quadricep muscles. Preferably, bars 18 and 20 are padded as shown at 18A, 20A to provide a more comfortable ankle engaging surface.

Attached to the second arm 16 is a weight receiving bar 22 onto which may be placed weights 23 to vary the resistance of the leg lift device. Simple and inexpensive barbell weights can be placed on bar 22, thus avoiding the need for expensive, complex, large weight and pulley arrangements. A flange 24 serves to retain the weights in a fixed, desired position at one end of bar 22 and a removable collar 26 secures the weights on bar 22 in a manner conventional in the art. The resistance of the exercise device may be adjusted by increasing or decreasing the amount of weight on bar 22. The weight receiving bar 22 is perpendicular to the second arm 16 and essentially parallel to the first arm 14. It extends in the same direction as the first arm 14.

A mounting bracket 28 is used to pivotably mount the L-shaped rod 12 to a bench B. Rod 12 is pivoted in bracket 28 on bolt 40. The mounting bracket includes two spaced vertical plates 30 which are welded at 42 to a pair of mounting arms 31. The mounting arms may be attached to either the horizontal frame F of the bench as shown in FIGS. 1-5 or to the legs of the bench. The mounting arms may be permanently fixed to the bench or may provide for a removable connection, such as screw and nut connections shown in FIG. 2, so that the entire leg lift exercise device can be removed from the bench.

A T-shaped knee support 32 is adjustably mounted in an upright tubular support 33 welded between the mounting plates 30. The knee support 32 includes a bar 34 having padded limbs 34A and a mounting bar or stem 36. Stem 36 is slideably and removably received within upright tubular support 33. The knee support may be adjusted by a bolt 38, which passes through a hole in the tubular support 33 and engages one of a series of corresponding holes in the mounting bar 36.

Figure 4:
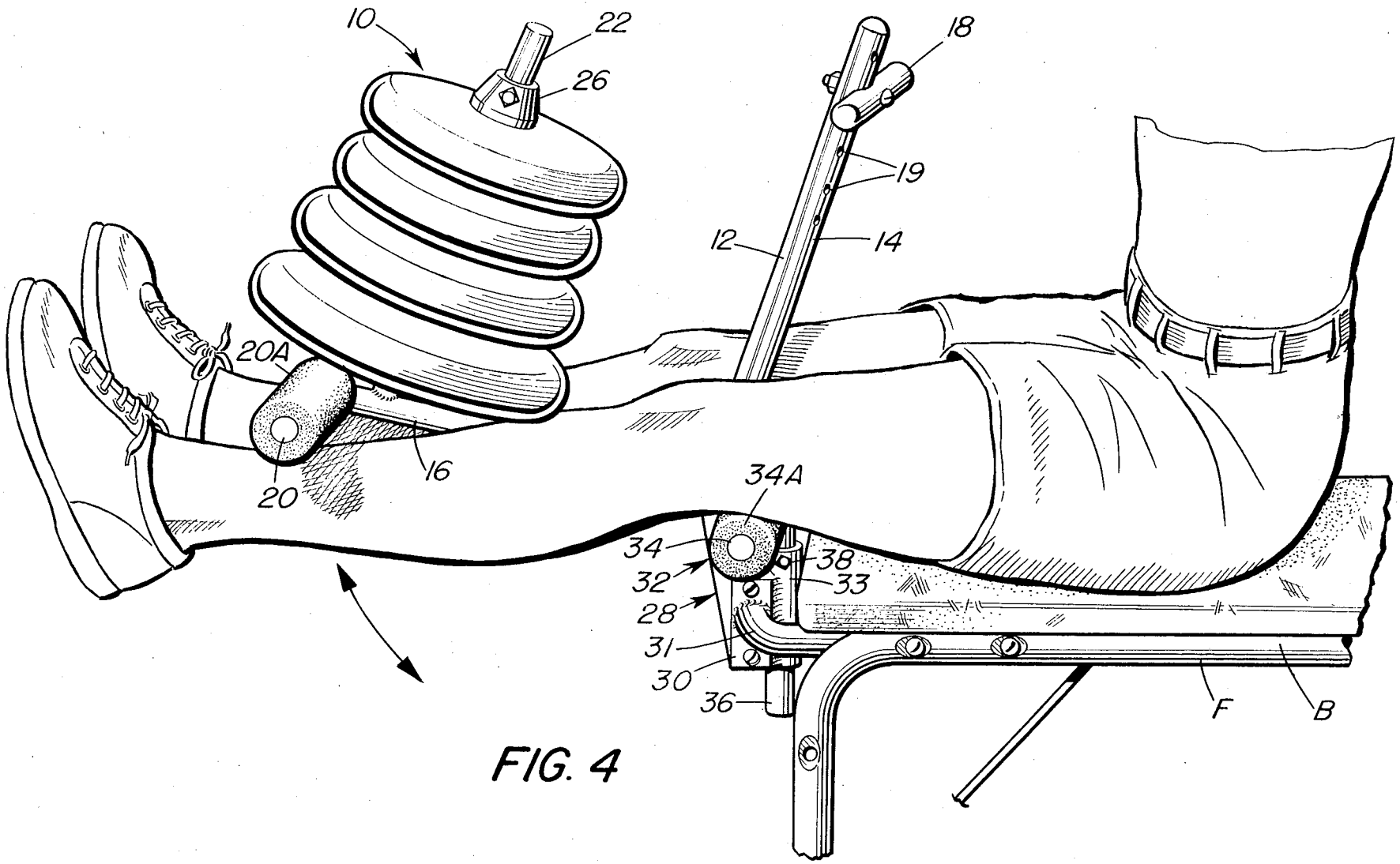
FIG. 4 is a perspective view of the invention being used to exercise the quadricep muscles.

When the leg lift device is used for exercising the quadricep muscles, as shown in FIG. 4, the user sits on the end of the bench with the back of the user's knees supported by the knee support 32. The user adjusts the knee support so that the user's ankles engage the ankle engaging bar 20. The device is now adjusted so that the exercise can be performed properly. By exerting a force on the ankle engaging bar 20, and straightening the user's leg, the exercise device pivots about pivot point 40. The legs are then lowered to the original position and the exercise is repeated. Since the knee support 32 is in close proximity to pivot point 40, the resistance throughout the entire range of motion is essentially uniform, since the moment arm between the knee and ankle is essentially constant.

Figure 5:
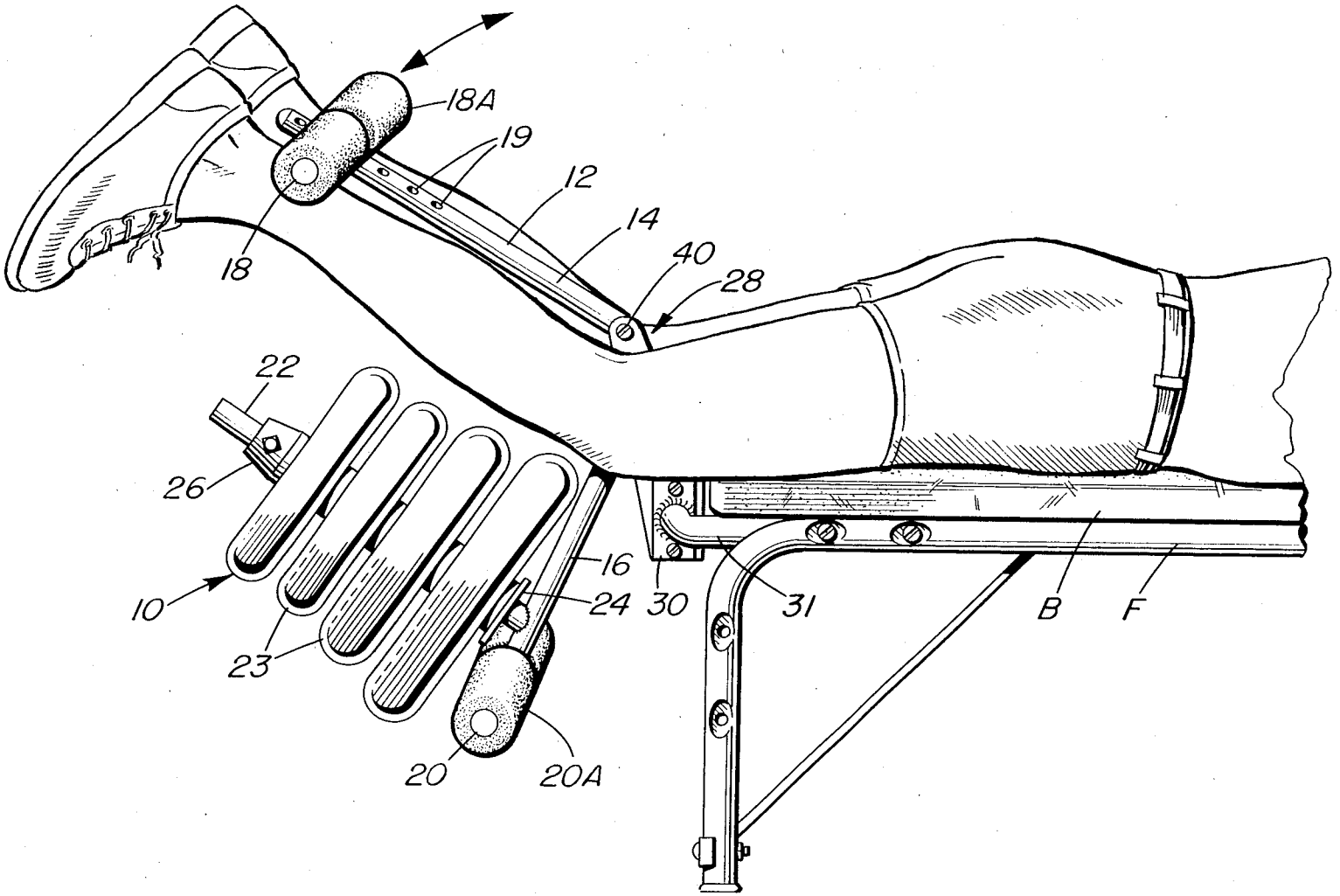
FIG. 5 is a perspective view of the invention being used to exercise the hamstring muscles, with the knee support removed.

When using the exercise device to exercise the hamstring muscles, shown generally in FIG. 5, the knee support 32 must be removed in order to allow the ankles to properly engage the ankle engaging bar 18. Accordingly, the present invention allows for the knee support 32 to be removed completely from the tubular support 33. To exercise the hamstring muscles, the user adjusts the position of ankle engaging bar 18 to his calf length, and lies on his stomach with the back of the ankles engaging ankle engaging bar 18. The legs are then flexed to bend at the knee joint, moving the weighted device about pivot 40. The legs are then lowered and the exercise is repeated.

With knee support 32 removed, it also is possible to use the exercise device for exercising the arms. This is done by grasping ankle engaging bar 18 with the hands and rotating L-shaped rod 12 against the resistance of weights 23. The type of arm exercise performed (e.g., curls) will depend on the location and orientation of the user relative to bench B and L-shaped rod 12.

The present invention provides a leg exercise device which may be used to exercise both the quadricep muscles and the hamstring muscles as well as the muscles of the arms and upper torso. The invention provides for an adjustable knee support which allows the leg to be properly positioned so that the quadricep exercise can be performed safely and with maximum benefit. While the invention has been described with reference to a particular embodiment, variations will be apparent to those skilled in the art. For example, adjustable mounting of ankle engaging bar 18 can be accomplished by perpendicularly securing bar 18 to a short tube which telescopes on arm 14 and can be pinned thereto through any hole 19. In addition, a longer ankle engaging bar 20 can be substituted for weight receiving bar 22. The outer portions of bar 20 would carry the weights, with suitable locking collars, while the inner portions would be padded for engagement by the ankles. The invention is not intended to be limited by the above preferred or any other embodiment, but is defined and limited only by the following claims.

I claim:

1. A leg exercise device comprising:

a floor-supported bench having a seat adjacent one end thereof;

an L-shaped member having two arms, said L-shaped member being pivoted intermediate its ends to one end of said bench about a horizontal axis higher than said seat with one of said arms above the other;

a lower ankle-engaging member attached to the lower of said arms;

an upper ankle-engaging member attached to the upper of said arms;

force-applying means attached to one of said arms for resisting upward rotation of said arms by a force applied by a user's leg to either of said ankle-engaging members;

a separate knee support; and mounting means for vertically adjustably securing said knee support to said one end of said bench independently of said L-shaped member to provide adjustable support for a user's knee when seated on said seat and performing leg lifts, so that the user's ankle properly can engage said lower ankle-engaging member and the user's foot can clear the floor.

2. A leg lift exercise device adapted to be fastened to a floor-supported exercise bench having a seat adjacent one end thereof, comprising:

mounting means for fastening the device to said one end of said bench;

an L-shaped member having two arms, said L-shaped member being pivoted intermediate its ends to said mounting means about a horizontal axis higher than said seat with one of said arms above the other;

a lower ankle-engaging member attached to the lower of said arms;

an upper ankle-engaging member attached to the upper of said arms;

force-applying means attached to one of said arms for resisting upward rotation of said arms by a force applied by a user's leg to either of said ankle-engaging members; and a separate knee support attached to said mounting means, said mounting means vertically adjustably carrying said knee support independently of said L-shaped member to provide adjustable support for a user's knee when seated on said seat and performing leg lifts, so that the user's ankle properly can engage said lower ankle-engaging member and the user's foot can clear the floor.

3. A leg lift device according to claim 1 or 2 wherein said mounting means comprises a pair of spaced pivot brackets between which said L-shaped member is pivoted, and an upright knee support bracket secured to said pivot brackets to which said knee support is adjustably and removably attached.

4. A leg lift device according to claim 3 wherein said knee support comprises a T-shaped member having padded lateral knee-engaging limbs and a central depending stem which engages said knee support bracket.

5. A leg lift device according to claim 4 wherein said knee support bracket comprises a knee support tube having a pair of aligned pin-receiving apertures, and said stem has a plurality of spaced pairs of pin-receiving apertures and is adapted to be received within said knee support tube.

6. A leg lift device according to claim 2 wherein said mounting means comprises a pair of spaced pivot brackets between which said L-shaped member is pivoted, an upright knee support bracket secured to said pivot brackets to which said knee support is adjustably and removably attached, and a mounting arm attached to each of said pivot brackets, said mounting arms having generally parallel terminal portions which are adapted to be fastened to the frame members of the exercise bench.

7. A leg lift device according to claim 1 or 2 wherein said upper ankle-engaging member can be adjustably positioned along the length of the first arm.

8. A leg lift device according to claim 1 or 2 wherein said mounting means removably secures said knee support to said bench.

* * * * *